United States Patent [19]

Smith

[11] Patent Number: 4,467,920

[45] Date of Patent: Aug. 28, 1984

[54] BOOK SAFE

[75] Inventor: Thomas J. Smith, Hopewell Junction, N.Y.

[73] Assignee: The Reader's Digest Association, Inc., New Castle, N.Y.

[21] Appl. No.: 507,077

[22] Filed: Jun. 23, 1983

[51] Int. Cl.[3] ..... B65D 5/56; B65D 6/02

[52] U.S. Cl. ..... 206/457; 229/8; 109/59 R

[58] Field of Search ..... 206/457; 229/8; 109/59

[56] References Cited

U.S. PATENT DOCUMENTS

| | | | |
|---|---|---|---|
| 1,646,632 | 10/1927 | Spinner | 206/457 |
| 1,709,685 | 4/1929 | Rothrock | 229/8 |
| 1,738,333 | 12/1929 | Szymanski | 229/8 |
| 1,756,135 | 4/1930 | Ruskin | 229/8 |
| 1,963,552 | 6/1934 | Horwitt | 229/8 |
| 2,061,992 | 11/1936 | Wilson | 229/8 |
| 2,341,600 | 2/1944 | Daniel | 206/457 |
| 2,679,812 | 10/1954 | Phillips | 206/457 |

*Primary Examiner*—William T. Dixson, Jr.
*Attorney, Agent, or Firm*—John Gibson Semmes

[57] ABSTRACT

A book safe characterized by moveable and immoveable covers connected by a backbone, the immoveable cover containing a reinforced receptacle for valuables, both said covers being interconnected and retained against separation by a velour lining, the book safe having simulated gilded edges on the exterior of the receptacle. The book safe is intended to simulate a volume of a Reader's Digest Condensed Book.

4 Claims, 2 Drawing Figures

BOOK SAFE

BACKGROUND OF THE INVENTION

This invention is termed a book safe, the same being adapted to the secret containment of personal valuables and the like. Whereas book safes have been the subject of numerous patents and applications therefor, none has combined the concept of durability with an especial lining and simulated gilded edges. The art is perhaps best represented by the following U.S. Letters Patents:

I. Iscowitz U.S. Pat. No. 1,445,593

J. S. Newman U.S. Pat. No. 1,729,518

W. Waisgerber U.S. Pat. No. 3,191,319

L. E. Schwartz U.S. Pat. No. 3,503,141

The earliest of patents, namely the Iscowitz and Newman patents, most closely approximate the present invention. Nonetheless, in neither of these patents is a sophisticated and hinged reinforcement, enhanced by a velour lining and other features hereinafter presented.

SUMMARY OF THE INVENTION

This book safe presents a fully open interior which is bound on the backbone and back cover by an encompassing reinforced construction. The interior reinforces the exterior cover in the following manner: first, an essentially rectangular insert is placed in close-fitting relationship to the cover and to the receptacle of the book safe, per se. Superimposed over the interior is a lining which is composed of a sufficiently strong material, for the intended purpose, wherein at least a portion thereof overlying the interconnection between the front cover and the backbone of the case, forms a delimiting hinge, the inner portion of the lining having interconnection and being in contiguous contact with the interior container.

DESCRIPTION OF THE PREFERRED EMBODIMENTS

Figure 2:
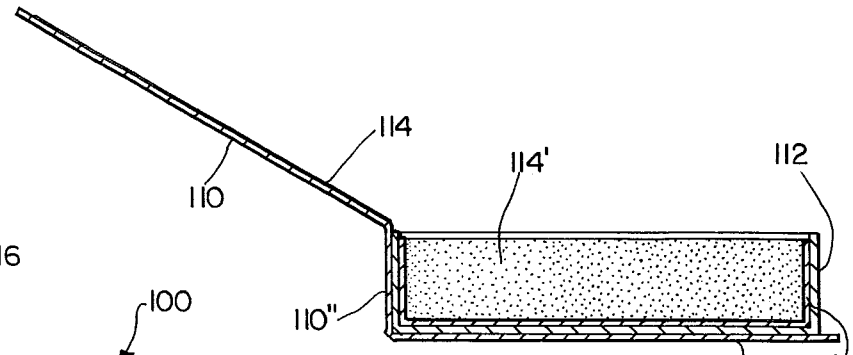
FIG. 2 is a view in vertical cross section of the invention, taken along the lines 2—2 of FIG. 1.
Figure 1:
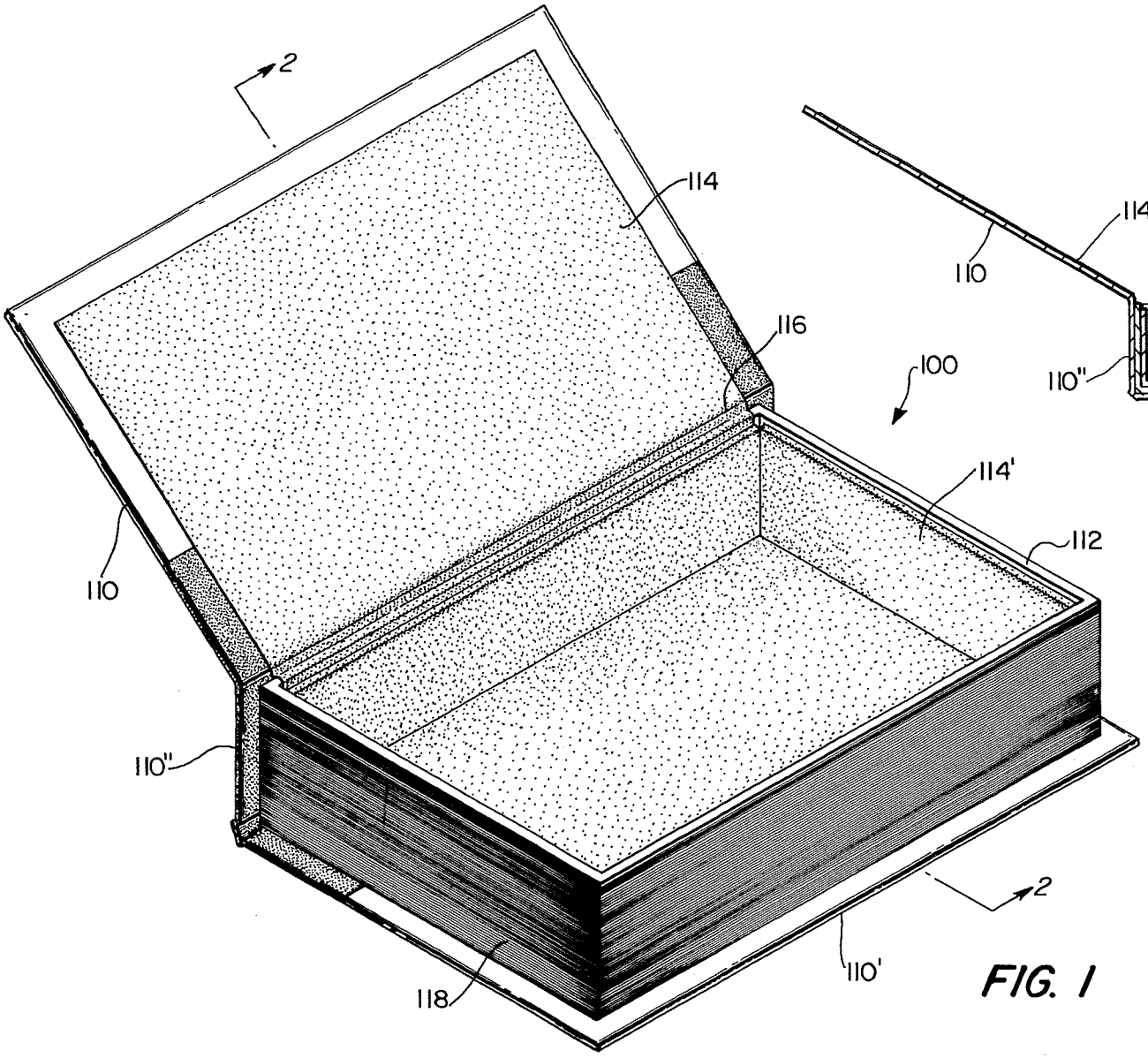
FIG. 1 is in view a perspective of invention, showing the front cover in open position.

The book safe 100 comprises in detail a moveable cover 110 which is connected to a fixed cover 110', the backbone 110' interconnecting these respective elements of the cover. The back cover provides a base for a rectangular open box, the box comprising a bottom with connecting outer and inner walls, the outer walls forming a base for the simulated gilded edges 118, and the inner wall providing a reinforcement to the construction, as a whole. The respective outer and inner walls 112—112' are adhesively bonded to one another as will be apparent from reference to FIG. 2. A lining 114,114' is bounded to the respective inner cover of the moveable front cover 110 and to the inner portion of the box 112. A velour lining is preferable, inasmuch as the lining being tufted at 116 forms a delimiting hinge element which interconnects the front cover to the receptacle.

The operative functions of the various elements will be apparent from reference to the drawings, suffice it to say that the box comprises a repository for valuables such as jewelry and the like, especially as the front cover is closed upon the receptacle. The simulated gilded edges which are placed upon the exterior of the walls of the case are striated so that the exterior simulates a gold leaf application.

I claim:

1. A book safe comprising:

A. a cover, said cover including therein a movable front and an immovable back and connecting backbone therebetween;

B. a receptacle secured to the interior of the immovable back of the cover, said receptacle being reinforced on at least four sides thereof;

C. a blanket lining for the book safe, said lining overlying the interior of the front of the cover and the receptacle, in contiguous contact therewith, a portion of the lining adjacent the backbone, between the front of the cover and receptacle being detached from the front and receptacle, adhering to a portion of the backbone to provide a delimiting hinge between the front and the receptacle.

2. The book safe according to claim 1, wherein the lining (C) is composed of a velour, the same being bonded on its inside to the front of the cover and to the receptacle.

3. The book safe according to claim 1 or 2 wherein the book safe simulates a condensed books volume.

4. The book safe according to either claim 1 or 2 or 3 wherein the book safe simulates a volume of a Reader's Digest Condensed Book.

* * * * *